US009669408B2

(12) United States Patent
Lin et al.

(10) Patent No.: US 9,669,408 B2
(45) Date of Patent: Jun. 6, 2017

(54) SLIGHT VOLUME COLLECTOR

(71) Applicant: HTC Corporation, Taoyuan (TW)

(72) Inventors: Sheng-Chieh Lin, Taoyuan (TW); Pin-Chung Sun, Taoyuan (TW); Yao-Ting Tseng, Taoyuan (TW); Shih-Jen Lu, Taoyuan (TW); Chung-Ju Wu, Taoyuan (TW); Chien-Lung Huang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 17 days.

(21) Appl. No.: 14/555,691

(22) Filed: Nov. 28, 2014

(65) Prior Publication Data

US 2016/0151777 A1 Jun. 2, 2016

(51) Int. Cl.
*B01L 3/00* (2006.01)

(52) U.S. Cl.
CPC ... *B01L 3/502715* (2013.01); *B01L 2200/026* (2013.01); *B01L 2200/16* (2013.01); *B01L 2300/047* (2013.01); *B01L 2300/0816* (2013.01); *B01L 2300/0867* (2013.01); *B01L 2400/0406* (2013.01); *B01L 2400/0457* (2013.01)

(58) Field of Classification Search
CPC ..... C12Q 1/005; G01N 27/3272; A61B 5/150343; B01L 3/502715
See application file for complete search history.

(56) References Cited

U.S. PATENT DOCUMENTS

2004/0020771 A1* 2/2004 Taniike ..... G01N 27/3272 204/403.14
2006/0263914 A1* 11/2006 Sando ..... B01L 3/502707 438/14
2014/0342371 A1* 11/2014 Holmes ..... A61B 5/150251 435/6.12

FOREIGN PATENT DOCUMENTS

| | | |
|---|---|---|
| CN | 1453580 | 11/2003 |
| CN | 101176001 | 5/2008 |
| CN | 101208598 | 6/2008 |
| TW | 200831301 | 8/2008 |

OTHER PUBLICATIONS

"Office Action of Taiwan Counterpart Application," issued on Aug. 27, 2015, p. 1-p. 5.

* cited by examiner

*Primary Examiner* — Sally Merkling
(74) *Attorney, Agent, or Firm* — Jianq Chyun IP Office

(57) ABSTRACT

A slight volume collector adapted to collect a sample liquid with slight volume and be assembled to a detecting device is provided. The slight volume collector includes a body and an extension part. The extension part extends outward from the body and protrudes from the body. The extension part has a through hole, and the through hole passes through the extension part and corresponds to the body. The sample liquid is adapted to be adhered to and arranged in the through hole due to capillarity, and a volume of the sample liquid is substantially equal to a capacity of the through hole.

9 Claims, 4 Drawing Sheets

SLIGHT VOLUME COLLECTOR

FIELD OF THE INVENTION

The invention generally relates to a collector and particularly relates to a slight volume collector.

DESCRIPTION OF RELATED ART

Recently, miniaturized biochemical analytical systems have been developing and have been applied to various detecting devices. Miniaturization of the biochemical analytical systems is conducive to rapid analysis, accuracy of quantitative results, reduction of the required amount of samples, effective space utilization, and so on; hence, more and more detecting devices have been designed in compliance with the trend of miniaturization.

In the existing biochemical analytical systems, sample liquid with slight volume flows through a micro-channel structure, and some constituents are separated from the sample liquid; after separation, the sample liquid flows into a biochip, and the biological characteristics can then be detected. Since the required amount of the sample liquid in the miniaturized biochemical analytical system is small, a pipette-type apparatus is often applied to absorb the sample liquid with slight, fixed volume, and a reagent liquid with fixed volume is mixed with the sample liquid. The mixture is then dropped into the micro-channel structure and flows into the biochip. Practically speaking, however, the way to absorb the sample liquid with slight volume by employing the pipette-type apparatus causes inconvenience to normal users.

SUMMARY OF THE INVENTION

The application is directed to a slight volume collector adapted to collect a sample liquid with slight volume, and the slight volume collector can be operated easily.

In an embodiment of the invention, a slight volume collector adapted to collect a sample liquid with slight volume and be assembled to a detecting device is provided. The slight volume collector includes a body and an extension part. The extension part extends outward from the body and protrudes from the body. The extension part has a through hole, and the through hole passes through the extension part and corresponds to the body. The sample liquid is adapted to be adhered to and arranged in the through hole due to capillarity, and a volume of the sample liquid is equal to a capacity of the through hole.

In view of the above, the slight volume collector includes the body and the extension part that extends outward from the body and protrudes from the body, and the extension part has a through hole that passes through the extension part and corresponds to the body. Thereby, the slight volume collector described herein is adapted to collect a sample liquid with slight volume and adapted to be assembled to a detecting device, and the sample liquid with slight volume is adhered to and arranged in the through hole due to capillarity. As a result, the slight volume collector can be employed to collect a sample liquid with slight volume, and the slight volume collector can be operated easily.

Several exemplary embodiments accompanied with figures are described in detail below to further describe the invention in details.

DETAILED DESCRIPTION OF DISCLOSED EMBODIMENTS

Figure 1:
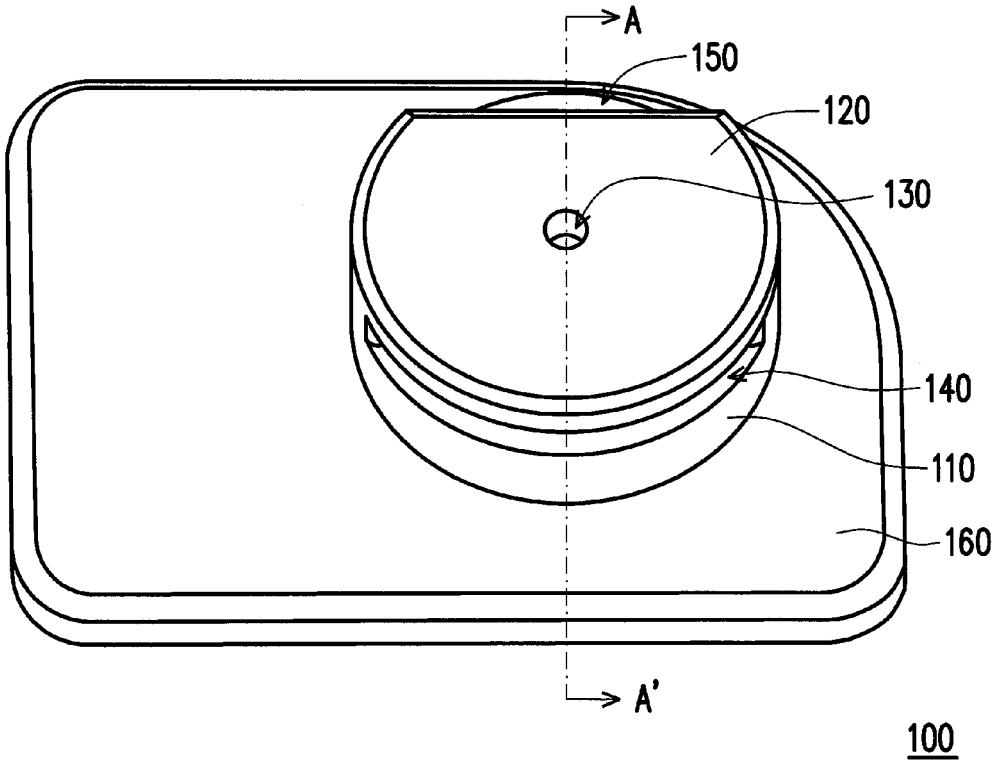
FIG. 1 is a three-dimensional view of a slight volume collector according to an embodiment of the invention.
Figure 2:
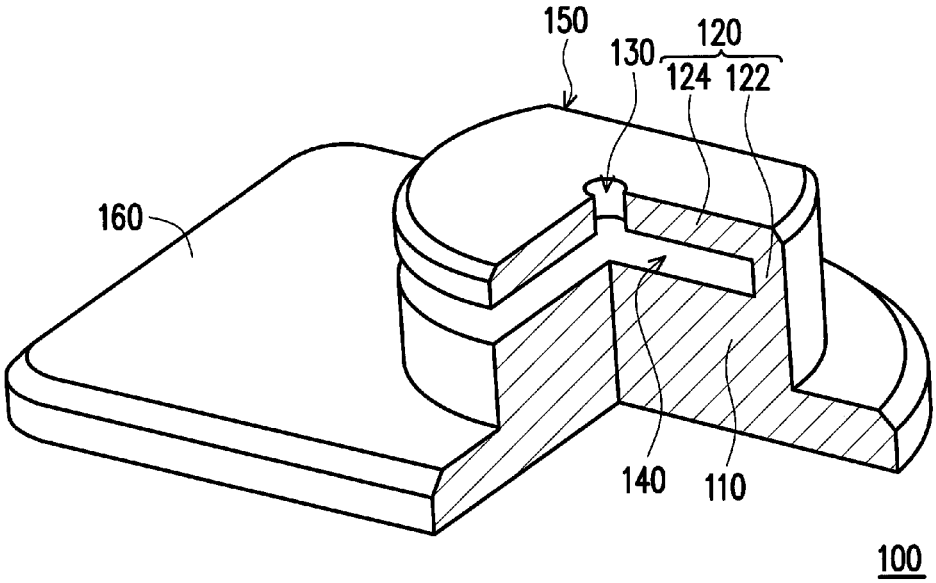
FIG. 2 is a schematic partial cross-sectional view of the slight volume collector depicted in FIG. 1.
Figure 3:
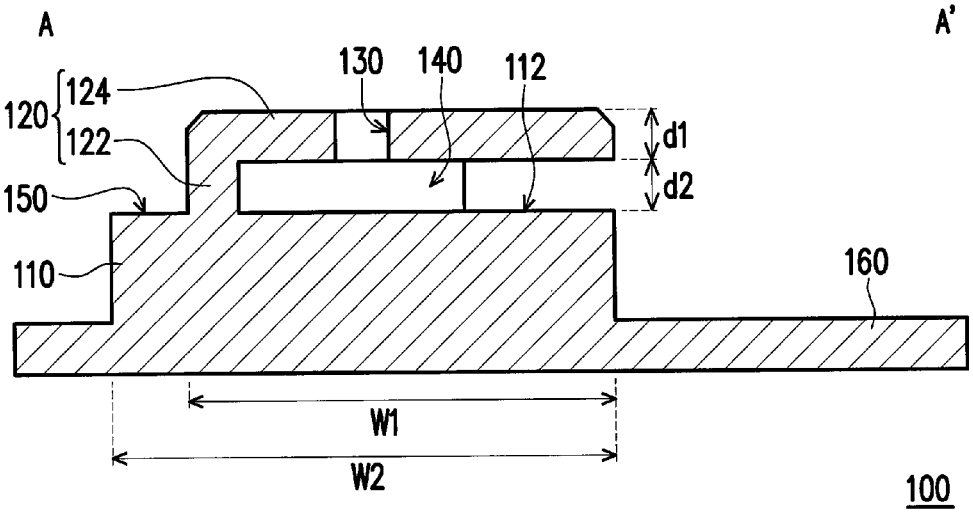
FIG. 3 is a schematic cross-sectional view of the slight volume collector depicted in FIG. 1 along a line A-A'.

FIG. 1 is a three-dimensional view of a slight volume collector according to an embodiment of the invention. FIG. 2 is a schematic partial cross-sectional view of the slight volume collector depicted in FIG. 1. FIG. 3 is a schematic cross-sectional view of the slight volume collector depicted in FIG. 1 along a line A-A'. With reference to FIG. 1 to FIG. 3, in the present embodiment, the slight volume collector 100 includes a body 110 and an extension part 120. The extension part 120 extends outward from the body 110 and protrudes from the body 110. The extension part 120 has a through hole 130, and the through hole 130 passes through the extension part 120 and corresponds to the body 110. Thereby, the slight volume collector 100 is adapted to collect a sample liquid with slight volume and be assembled to a detecting device (not shown), wherein the sample liquid is adapted to be adhered to and arranged in the through hole 130 due to capillarity, and a volume of the sample liquid is substantially equal to a capacity of the through hole 130. To be specific, when the sample liquid is in contact with the through hole 130 of the slight volume collector 100, the sample liquid flows into the through hole 130 of the slight volume collector 100 due to capillarity and is adhered to and arranged in the through hole 130 of the slight volume collector 100. Here, the volume of the sample liquid adhered to and arranged in the through hole 130 is substantially equal to the capacity of the through hole 130. The sample liquid collected by the volume collector 100 can then have the fixed volume. The sample liquid with different volumes can be collected merely by adjusting the capacity of the through hole 130 of the slight volume collector 100.

The sample liquid is, for instance, blood, and the reagent liquid is phosphate buffered saline (PBS), for instance. When a user intends to measure a specific biochemical index in the blood, the user pricks his or her finger with a needle and squeezes the finger for a drop of blood. The drop of blood is in contact with the through hole 130 and then enters the through hole 130 due to capillarity, and the rest of the blood drop not entering the through hole 130 is cleaned. Thereby, the blood sample with slight, fixed volume can be collected as the sample liquid. Compared to the conventional way to absorb the sample liquid by employing the pipette-type apparatus, the way to collect the sample liquid with slight, fixed volume by applying the slight volume collector 100 provided herein is rather easy and simple.

Specifically, in the present embodiment, the extension part 120 is spaced from a surface 112 of the body 110 by a distance, so as to constitute a channel 140 therebetween, and the through hole 130 communicates with the channel 140. That is, the extension part 120 extends outward from the body 110 and protrudes from the body 110, and there is a distance between the extension part 120 an the surface 112 of the body 110, so as to form the channel 140 between the extension part 120 and the surface 112 of the body 110; besides, the through hole 130 passing through the extension part 120 communicates with the channel 140. The reagent liquid that is not shown in the drawings is adapted to flow into the through hole 130 through the channel 140 and flow out of the slight volume collector 100 together with the sample liquid through the through hole 130. According to the present embodiment, an orthogonal projection area of the channel 140 relative to the body 110 is greater than an orthogonal projection area of the through hole 130 relative to the body 110; particularly, a capacity of the channel 140 is greater than the capacity of the through hole 130. Since the capacity of the through hole 130 poses an impact on the volume of the sample liquid, the capacity of the through hole 130 (including a depth d1 of the through hole 130 and the orthogonal projection area of the through hole 130 relative to the body 110) can be adjusted according to the required volume of the sample liquid. Under said circumstances, the capacity of the channel 140 (including a depth d2 of the channel 140 and the orthogonal projection area of the channel 140 relative to the body 110) can also be adjusted according to actual requirements. After the reagent liquid flows into the through hole 130 through the channel 140, the sample liquid and the reagent liquid converge, and accordingly the reagent liquid may flow out of the slight volume collector 100 together with the sample liquid through the through hole 130. As a result, the slight volume collector 100 contributes to the collection of the sample liquid with fixed, slight volume and is adapted to mix the sample liquid with the reagent liquid.

In the present embodiment, the extension part 120 includes a connection portion 122 and an extension portion 124. The connection portion 122 is connected to the body 110, the extension portion 124 extends outward from the connection portion 122, and the extension portion 124 and the surface 112 of the body 110 constitute the channel 140. Here, the connection portion 122 may be perpendicular to the surface 112 of the body 110, and the extension portion 124 may be parallel to the surface 112 of the body 110, such that the cross-section of the extension part 120 is substantially shaped as a letter L; however, the shape of the extension part 120 is not limited in the invention and can be adjusted according to actual requirements. Since the extension portion 124 extends outward from the connection portion 122 connected to the body 110, the extension portion 124 is parallel to the surface 112 of the body 110 and is spaced from the surface 112 of the body 110 by a distance, and the distance constitutes the channel 140 between the extension portion 124 of the extension part 120 and the surface 112 of the body 110.

In the present embodiment, the extension part 120 overlaps with the body 110, and at least one partial profile of the extension part 120 is identical to a profile of the body 110. Here, the connection portion 122 of the extension part 120 is spaced from an edge of the body 110 by a distance, such that a recess 150 is formed between the body 110 and the extension part 120 protruding from the body 110. Namely, the connection portion 122 of the extension part 120 is connected to the body 110 and located at one end of the body 110, and the connection portion 122 of the extension part 120 is spaced from the edge of the body 110 by a distance, such that the recess 150 is formed at the extension part 120 and the end of the body 110 corresponding to the connection portion 122. The extension portion 124 extends from the connection portion 122 toward the other end of the body 110 in a direction away from the recess 150, and the profile of the extension portion 124 is substantially the same as the profile of the body 110. In addition, one side of the extension part 120 corresponds to the recess 150, and thus an orthogonal projection area of the extension part 120 on a base plane is smaller than an orthogonal projection area of the body 110 on the base plane, i.e., a width W1 of the extension part 120 on a cross-section along the line A-A' is less than a width W2 of the body 110 on the cross-section along the line A-A' (as shown in FIG. 3). Since the connection portion 122 of the extension part 120 is perpendicular to the surface 112 of the body 110 and the extension portion 124 of the extension part 120 is parallel to the surface 112 of the body 110, the width W1 of the extension part 120 on the cross-section along the line A-A' is the width of the extension portion 124 on the cross-section along the line A-A', which should however not be construed as a limitation to the invention. The recess 150 may serve as a positioning or a locking structure while the slight volume collector 100 is assembled to the detecting device (not shown). However, the shape of the extension part 120, the location of the recess 150, and whether the recess 150 is formed or not, are not limited herein and are adjustable according to actual requirements.

In the present embodiment, the slight volume collector 100 further includes a holder 160. The holder 160 is located on the other side of the body 110 relative to the extension part 120, i.e., the holder 160, the body 110, and the extension part 120 are connected to one another from bottom to top, such that the body 110 is located between the holder 160 and the extension part 120. Besides, the holder 160 protrudes from the side edge of the body 110, i.e., a length of the holder 160 is greater than a length of the body 110, and the holder 160 extends to one side of the body 110. Thereby, the user may hold the holder 160 to collect the sample liquid with fixed, slight volume, and the sample liquid can then be adhered to and arranged in the through hole 130. The user may then hold the holder 160 with his or her hand and assemble the slight volume collector 100 to the detecting device with ease. In other words, since the holder 160 protrudes from the body 110, the user does not touch the sample liquid on the slight volume collector 100 if the user holds the holder 160.

Figure 4:
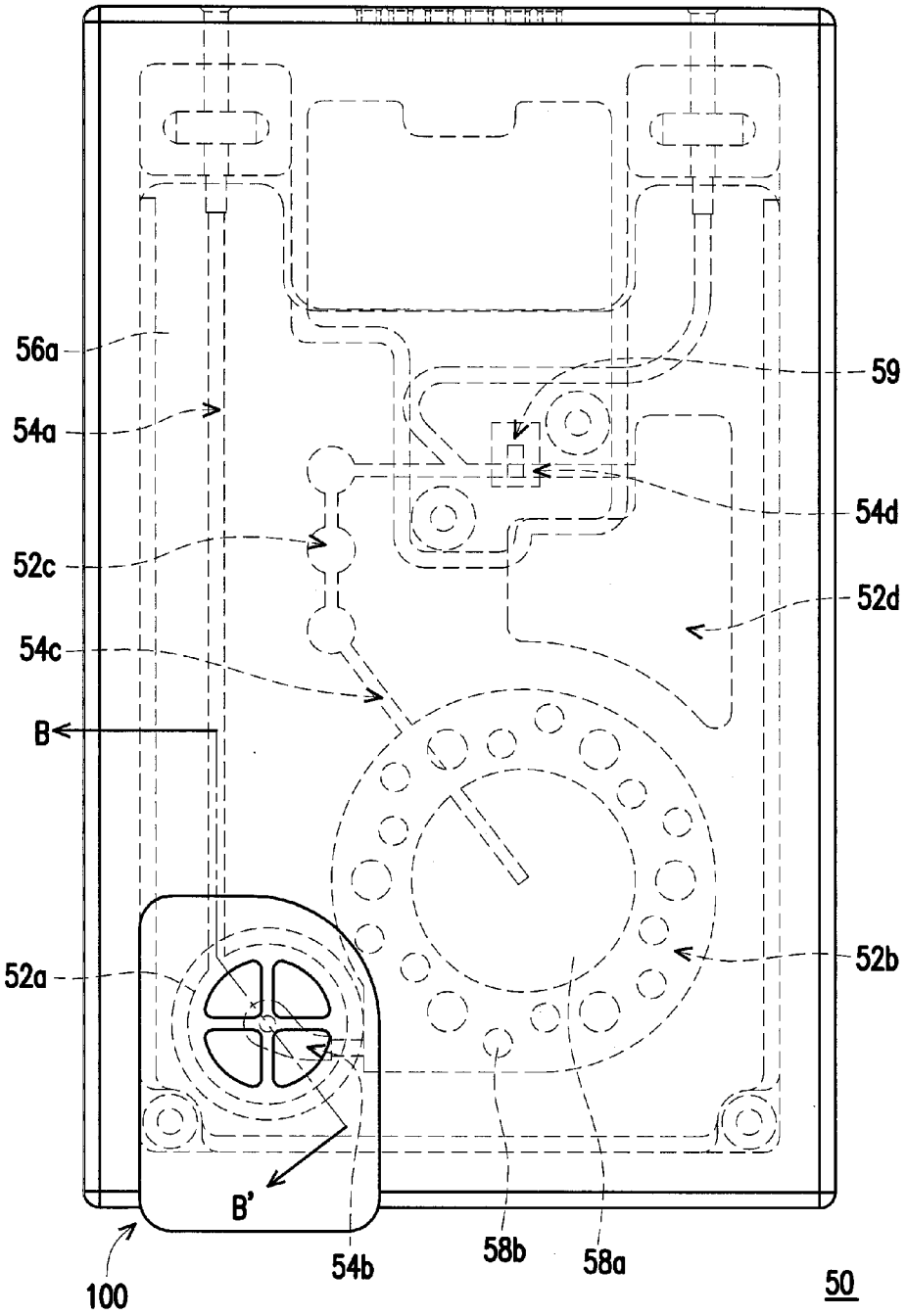
FIG. 4 is a schematic view of assembling the slight volume collector depicted in FIG. 1 to a detecting device.
Figure 5:
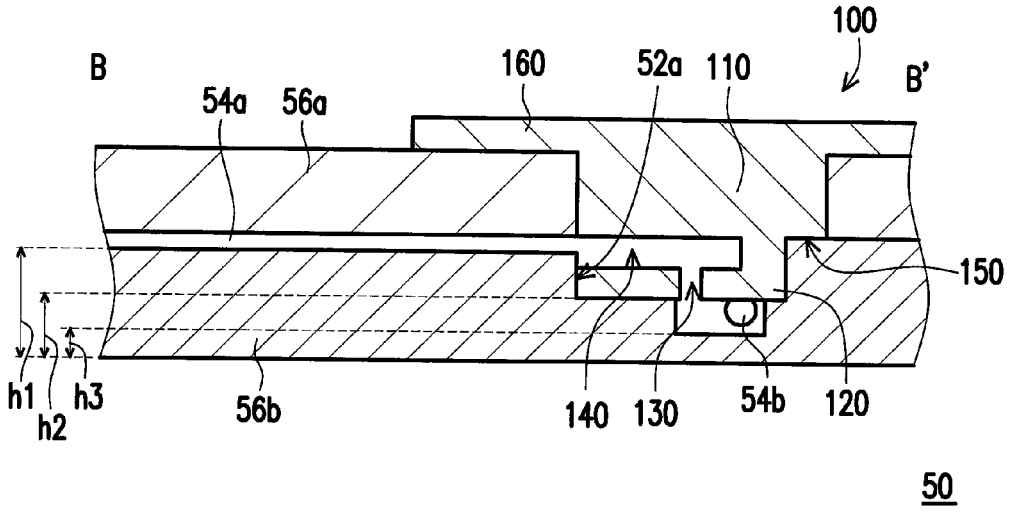
FIG. 5 is a schematic cross-sectional view of the slight volume collector and the detecting device depicted in FIG. 4 along a line B-B'.

FIG. 4 is a schematic view of assembling the slight volume collector depicted in FIG. 1 to a detecting device. FIG. 5 is a schematic cross-sectional view of the slight volume collector and the detecting device depicted in FIG. 4 along a line B-B'. With reference to FIG. 2 to FIG. 5, the slight volume collector 100 is adapted to collect the sample liquid with fixed, slight volume. That is, after the slight volume collector 100 collects the sample liquid with fixed, slight volume through the through hole 130, the slight volume collector 100 is assembled to a detecting device 50. Specifically, the detecting device 50 includes a plurality of recesses 52*a*-52*d* communicating with one another and a plurality of channels 54*a*-54*d*. The recesses 52*a*-52*d* and the channels 54*a*-54*d* can be formed between two boards 56*a* and 56*b*. Particularly, the recesses 52*a*-52*d* and the channels 54*a*-54*d* can be recesses or trenches arranged on the boards 56*a* and 56*b* and can be located between the boards 56*a* and 56*b* after the boards 56*a* and 56*b* are assembled. In FIG. 4, the channel structure (e.g., the recesses 52*a*-52*d* and the channels 54*a*-54*d*) located between the boards 56*a* and 56*b* is shown by dotted lines. Here, the recess 52*a* communicates with the channel 54*a*, and the recess 52*a* communicates with the recess 52*b* through the channel 54*b*. Moreover, the recess 52*b* communicates with the recess 52*c* through the channel 54*c*, and the recess 52*c* communicates with the recess 52*d* through the channel 54*d*. That is, the recesses 52*a*-52*d* and the channels 54*a*-54*d* communicate with each other, so as to constitute a continuous flow path between the boards 56*a* and 56*b*.

On the other hand, once the slight volume collector 100 is assembled to the detecting device 50, the slight volume collector 100 is arranged on the recess 52*a* of the detecting device 50. Here, the slight volume collector 100 is arranged in an upside-down manner in the recess 52*a*, and the extension part 120 and the through hole 130 of the slight volume collector 100 face the recess 52*a*. Besides, the recess 150 of the slight volume collector 100 leans against and is positioned at a side edge of the recess 52*a*, and the holder 160 covers the recess 52*a*. In FIG. 4, the holder 160 of the slight volume collector 100 is depicted by solid lines, and other components are depicted by dotted lines. The detailed structure of the slight volume collector 100 is also shown in FIG. 2 and FIG. 5. As such, the extension part 120 and the body 110 of the slight volume collector 100 are located in the recess 52*a*. The channel 140 corresponds to the channel 54*a* communicating with the recess 52*a*, and the through hole 130 corresponds to the channel 54*b* communicating with the recesses 52*a* and 52*b*. Thereby, the reagent liquid that is not shown in the drawings may flow into the slight volume collector 100 located in the recess 52*a* through the channel 54*b*. Here, the reagent liquid flows into the through hole 130 from the channel 54*a* through the channel 140 and flows out of the slight volume collector 100 together with the sample liquid through the through hole 130. The reagent liquid and the sample liquid then flow into the recess 52*b* from the through hole 130 through the channel 54*b* and are further mixed in the recess 52*b*. The mixture flows out of the recess 52*b* through the channel 54*c*. It can be derived from the above that the slight volume collector 100 is adapted to collect the sample liquid with fixed, slight volume from the detecting device (not shown) and is adapted to mix the sample liquid with the reagent liquid.

Moreover, a height h1 of the channel 54*a* relative to a base plane (e.g., the bottom of the board 56*b*) is greater than a height h2 of the recess 52*a* relative to the base plane, and the height h2 of the recess 52*a* relative to the base plane is greater than a height h3 of the channel 54*b* relative to the base plane, as shown in FIG. 5. The reagent liquid may flow from the channel 54*a* to the recess 52*a* that is lower than the channel 54*a*; after the reagent liquid and the sample liquid are converged, the converged liquid can then flow from the recess 52*a* to the channel 54*b* that is lower than the recess 52*a*. Based on actual needs, a first stopper 58*a* and a plurality of second stoppers 58*b* may be arranged in the recess 52*b*. The first stopper 58*a* is located in the recess 52*b* to form a circular channel, and the second stoppers 58*b* are distributed into the circular channel and disturb the reagent liquid and the sample liquid in the recess 52*b*, so as to form vortexes and ensure better mixture results.

In another aspect, a depth of the recess 52*b* may be greater than a depth of the channel 54*c*. Thereby, after the reagent liquid and the sample liquid are mixed in the recess 52*b*, some constituents (e.g., erythrocytes) may sink and may then be separated from the mixture. The separated constituents sink to the bottom of the recess 52*b*, and the mixture no longer containing the separated constituents then flow out of the recess 52*b* through the channel 54*c*. Said separation step may also be performed through the recess 52*c* and the channel 54*d*. For instance, the recess 52*c* communicates with the channels 54*c* and 54*d*, and a depth of the recess 52*c* is greater than a depth of the channel 54*d*. After the separation step is performed in the recess 52*b*, the mixture no longer containing the separated constituents may flow from the recess 52*b* to the recess 52*c* through the channel 54*c*, and some other constituents may further sink and may be further separated from the mixture in the recess 52*c*. After that, the mixture flows out of the recess 52*c* through the channel 54*d*.

The detecting device 50 may be equipped with a measuring area 59 according to actual requirements, and the measuring area 59 communicates with the recesses 52*b* and 52*c* as well as the channels 54*c* and 54*d*. As discussed above, the sample liquid is, for instance, blood, and the reagent liquid is PBS, for instance. The type of the reagent liquid may be adjusted in response to the type of the sample liquid and the required test items. After the reagent liquid and the sample liquid are mixed in the recess 52*b* and some constituents are separated from the mixture in the recess 52*b* or 52*c*, the mixture flows to the measuring area 59 through the channel 54*d*, and biological characteristics of the mixture can be inspected by the biochip (not shown) arranged in the measuring area 59. That is, before the biochip detecting, the reagent liquid and the sample liquid are already mixed, and some constituents may already be separated from the mixture; hence, it is possible to inspect the mixture by the biochip.

To sum up, the slight volume collector provided herein includes the body and the extension part that extends outward from the body and protrudes from the body, and the extension part has the through hole that passes through the extension part and corresponds to the body. Additionally, the extension part is spaced from the body by a distance to constitute the channel therebetween, and the through hole communicates with the channel. Thereby, the slight volume collector is adapted to collect the sample liquid with fixed, slight volume and adapted to be assembled into a detecting device, and the sample liquid with slight volume is adapted to be adhered to and arranged in the through hole due to capillarity. Note that the volume of the sample liquid is substantially equal to the capacity of the through hole. The reagent liquid is thus adapted to flow into the through hole through the channel, flow out of the slight volume collector together with the sample liquid with slight volume through the through hole, and flow into the detecting device. As a result, the slight volume collector is adapted to collect the sample liquid with fixed, slight volume in an easy and simple manner, and accurate quantitative results can be obtained, so as to ensure the subsequent detecting results.

Although the invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. A slight volume collector adapted to collect a sample liquid with slight volume and be assembled to a detecting device, the slight volume collector comprising:

a body; and an extension part extending outward from the body and protruding from the body, the extension part having a through hole, the through hole passing through the extension part and corresponding to the body, wherein the extension part is spaced from a surface of the body by a distance to become a cantilever hanging on the body and constitute a channel therebetween, and the through hole passing through the extension part is spaced from the surface of the body with the distance and communicates with the channel, so that the sample liquid is adapted to be adhered to and arranged in the through hole due to capillarity, and a reagent liquid is adapted to flow into the slight volume collector through the channel and flow out of the slight volume collector together with the sample liquid through the through hole, wherein the extension part comprises a connection portion and an extension portion, and the connection portion is located between the extension portion and the body and adjacent to the channel.

2. The slight volume collector according to claim 1, wherein the connection portion is connected to the body, the extension portion extends outward from the connection portion, and the extension portion and the surface of the body constitute the channel.

3. The slight volume collector according to claim 2, wherein the connection portion is perpendicular to the surface of the body, and the extension portion is parallel to the surface of the body.

4. The slight volume collector according to claim 2, wherein the connection portion is spaced from an edge of the body by a distance, such that a recess is formed between the body and the extension portion protruding from the body.

5. The slight volume collector according to claim 1, wherein the extension part overlaps with the body, and at least one partial profile of the extension part is identical to a profile of the body.

6. The slight volume collector according to claim 5, wherein an orthogonal projection area of the extension part on a base plane is smaller than an orthogonal projection area of the body on the base plane.

7. The slight volume collector according to claim 1, wherein an orthogonal projection area of the channel relative to the body is greater than an orthogonal projection area of the through hole relative to the body.

8. The slight volume collector according to claim 1, wherein a capacity of the channel is greater than a capacity of the through hole.

9. The slight volume collector according to claim 1, wherein the sample liquid comprises blood.

* * * * *